US006158086A

United States Patent [19]

De Souza

[11] Patent Number: 6,158,086

[45] Date of Patent: Dec. 12, 2000

[54] ADJUSTABLE BUTT HINGE

[76] Inventor: Stephen De Souza, 735 Ocean Ave., Apt. 2A, Brooklyn, N.Y. 11206

[21] Appl. No.: 09/382,061

[22] Filed: Aug. 24, 1999

[51] Int. Cl.[7] ..... E05D 7/04

[52] U.S. Cl. ..... 16/247; 16/237; 16/382; 16/387; 16/DIG. 43

[58] Field of Search ..... 16/247, 382, 236, 16/237, 238, 240, 387, DIG. 29, DIG. 43

[56] References Cited

U.S. PATENT DOCUMENTS

| | | | |
|---|---|---|---|
| 2,591,979 | 4/1952 | Turley | 16/247 |
| 3,263,368 | 8/1966 | Hildum et al. | 16/247 |
| 4,785,498 | 11/1988 | Brotschi | 16/238 |
| 4,881,296 | 11/1989 | Marinoni | 16/237 |
| 5,144,721 | 9/1992 | Schade | 16/237 |
| 5,555,605 | 9/1996 | Mosher | 16/247 |

*Primary Examiner*—Chuck Mah
*Attorney, Agent, or Firm*—Robert M. Downey, P.A.

[57] ABSTRACT

A hinge assembly includes a first hinge leaf for attachment to a door, a second hinge leaf hingedly coupled to the first hinge leaf, and a mounting plate for adjustably positioning and attaching the second hinge leaf to a cabinet frame, casing, door jamb, or the like. The mounting plate includes an elongate slot for receipt of a mounting screw therethrough, permitting movement of the mounting plate relative to the cabinet frame and mounting screw until the screw is tightened against the mounting plate. A window opening in the second hinge leaf exposes the elongate slot and mounting screw when the second hinge leaf is attached to the mounting plate, thereby permitting adjustable positioning of the door on the cabinet frame or other mounting structure.

6 Claims, 4 Drawing Sheets

ADJUSTABLE BUTT HINGE

BACKGROUND OF THE INVENTION

1. Field of the Invention

The present invention is directed to an adjustable butt hinge assembly and, more particularly, to a hinge assembly including a pair of hinge leaves hingedly coupled to one another and an adjustable mounting plate, wherein the adjustable mounting plate is adjustably positionable on a structure, such as a cabinet frame, to thereby permit proper alignment of a door once mounted to the cabinet.

2. Description of the Related Art

It is common to use a butt hinge for hingedly mounting a door to a cabinet, casing, a door jamb of a passage or entry way, or other like structures. A butt hinge, of the conventional type, includes a pair of plates or leaves each having one or more rolled, tubular segments or knuckles along a side edge. The knuckles of each leaf are specifically sized and arranged so as to mesh in axial alignment with the knuckles of the other leaf, thereby forming a hinge bone. A pin is inserted through the axially aligned knuckles to effectively couple the leaves so that they are movable relative to one another about a common axis, defined by the hinge pin. Each of the leaves are further provided with a plurality of apertures for passage of screws therethrough in order to attach one leaf to a door edge and the other leaf to the opposing face of the structure to which the door is being mounted.

When mounting a door to a structure, such as a cabinet or door frame (door jamb), two or more butt hinges are typically used. It is often difficult to position the door on the structure and attach the hinges at precise locations which will allow the door, once mounted, to close smoothly, in proper alignment with the structure. It is not until the door is mounted to the structure that proper alignment can be determined. However, once the hinges are mounted to the door and the structure, it becomes difficult to remove the hinges from the structure and/or door in order to adjustably position the hinges in a manner which proper aligns the door on the structure. Accordingly, the task of mounting a door to a cabinet, casing or door frame can often be time-consuming, tedious, and frustrating. In many instances, the removal and replacement of screws to adjust the positioning of the hinge causes damage to the mounting structure and door.

In view of the above noted problems associated with mounting a door to a cabinet, casing, door way and the like, there remains a need in the art for an adjustable hinge assembly which facilitates easy and convenient adjustment of a door relative to the mounting structure while the door and hinge assembly remain mounted to the structure.

SUMMARY OF THE INVENTION

The present invention is directed to a hinge assembly including a first hinge leaf for attachment to a door, a second hinge leaf hingedly coupled to the first hinge leaf, and a mounting plate for adjustably positioning and attaching the second hinge leaf to a cabinet frame, casing, door jamb, or the like. The mounting plate includes an elongate slot for receipt of a mounting screw therethrough, permitting movement of the mounting plate relative to the cabinet frame and mounting screw until the screw is tightened against the mounting plate. A window opening in the second hinge leaf exposes the elongate slot and mounting screw when the second hinge leaf is attached to the mounting plate, thereby permitting adjustable positioning of the door on the cabinet frame or other mounting structure.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
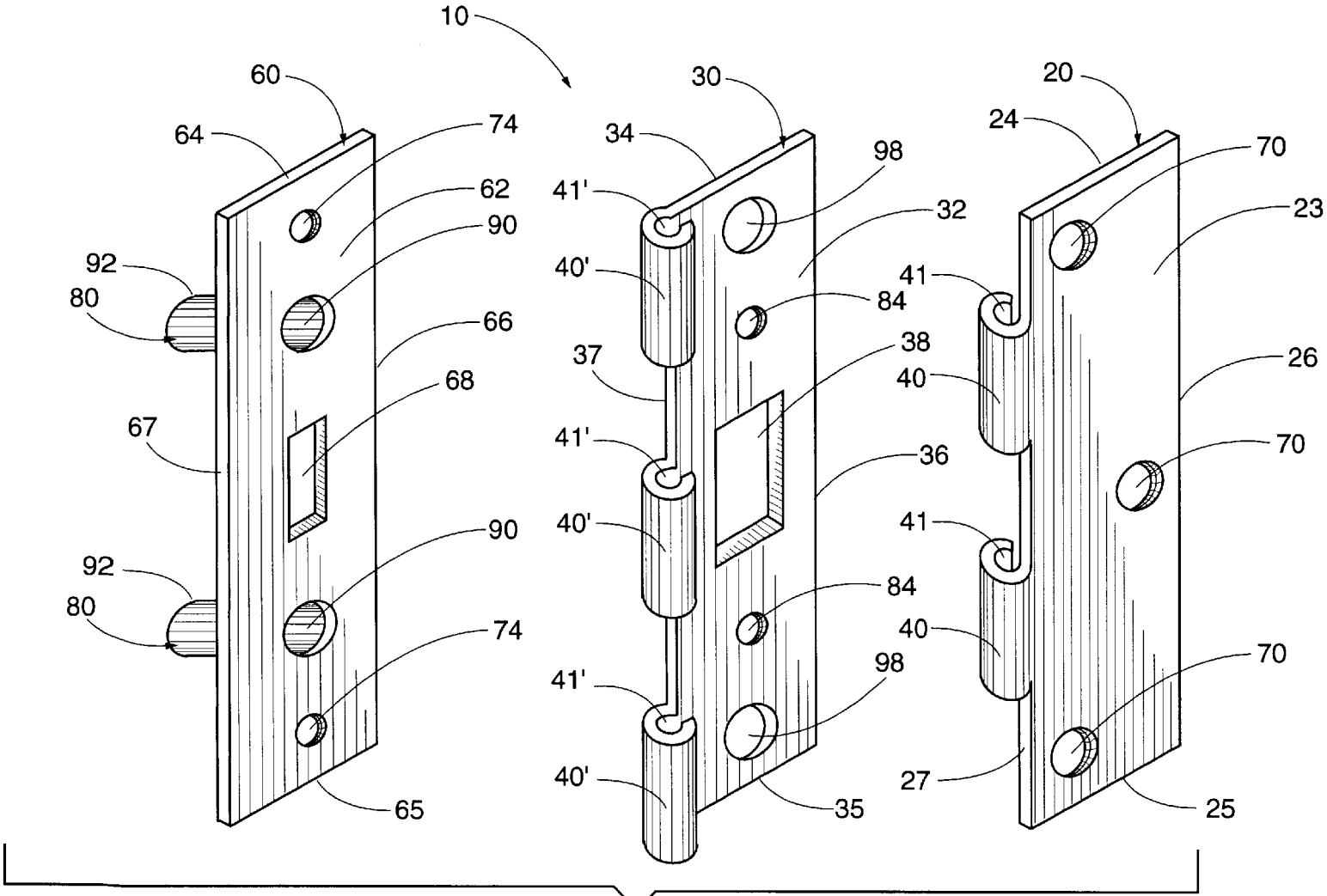
FIG. 1 is a perspective view showing the first hinge leaf, second hinge leaf, and adjustable mounting plate.
Figure 3:
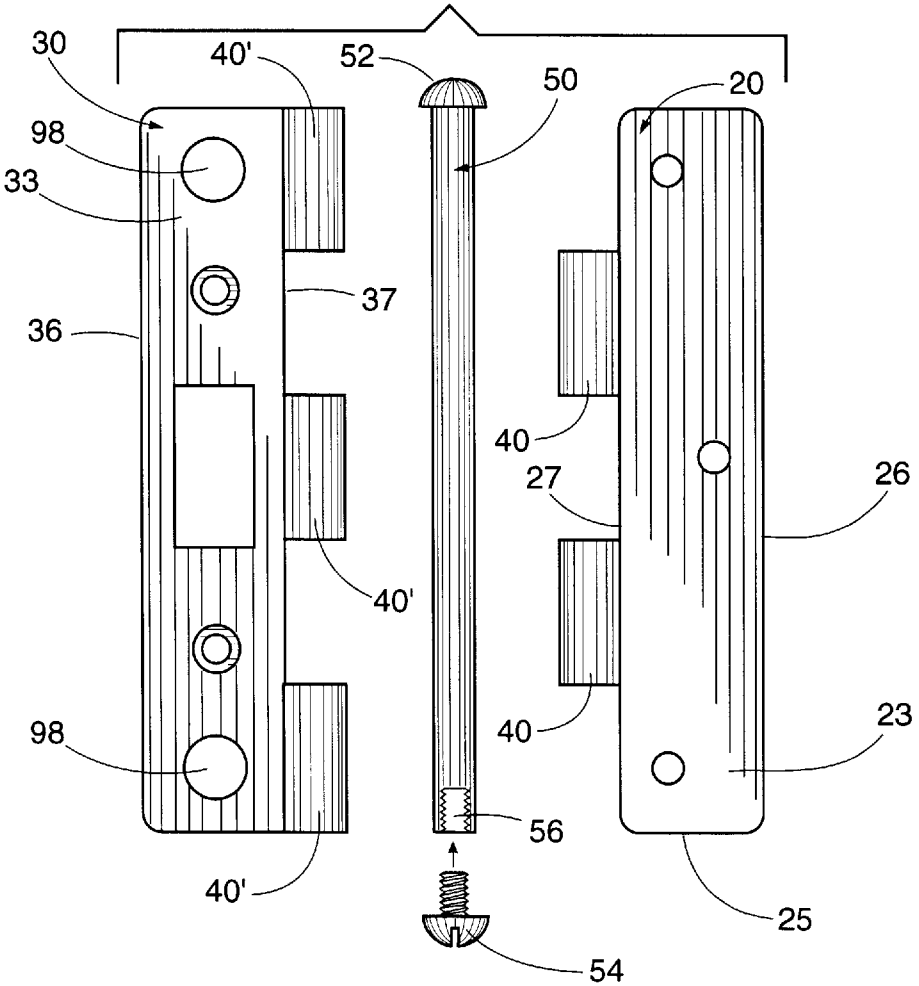
FIG. 3 is an elevational view showing the rear faces of the first and second hinge leaves and a hinge pin for hingedly coupling the hinge leaves.
Figure 2:
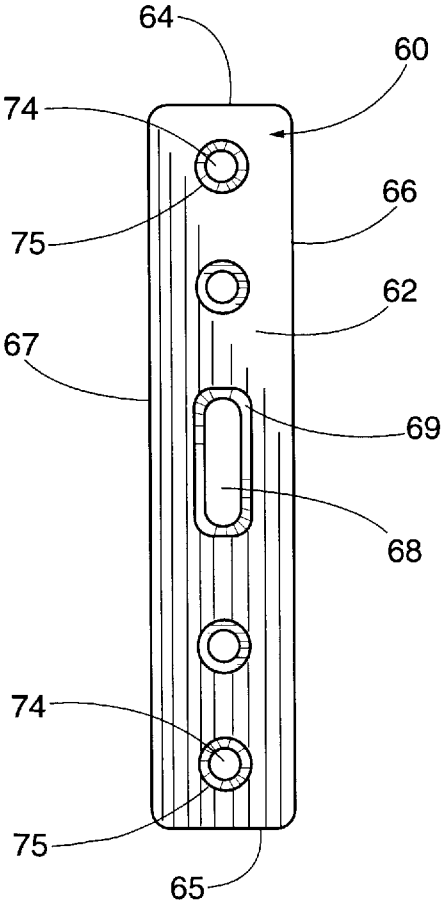
FIG. 2 is a front elevation of the adjustable mounting plate.
Figure 4:
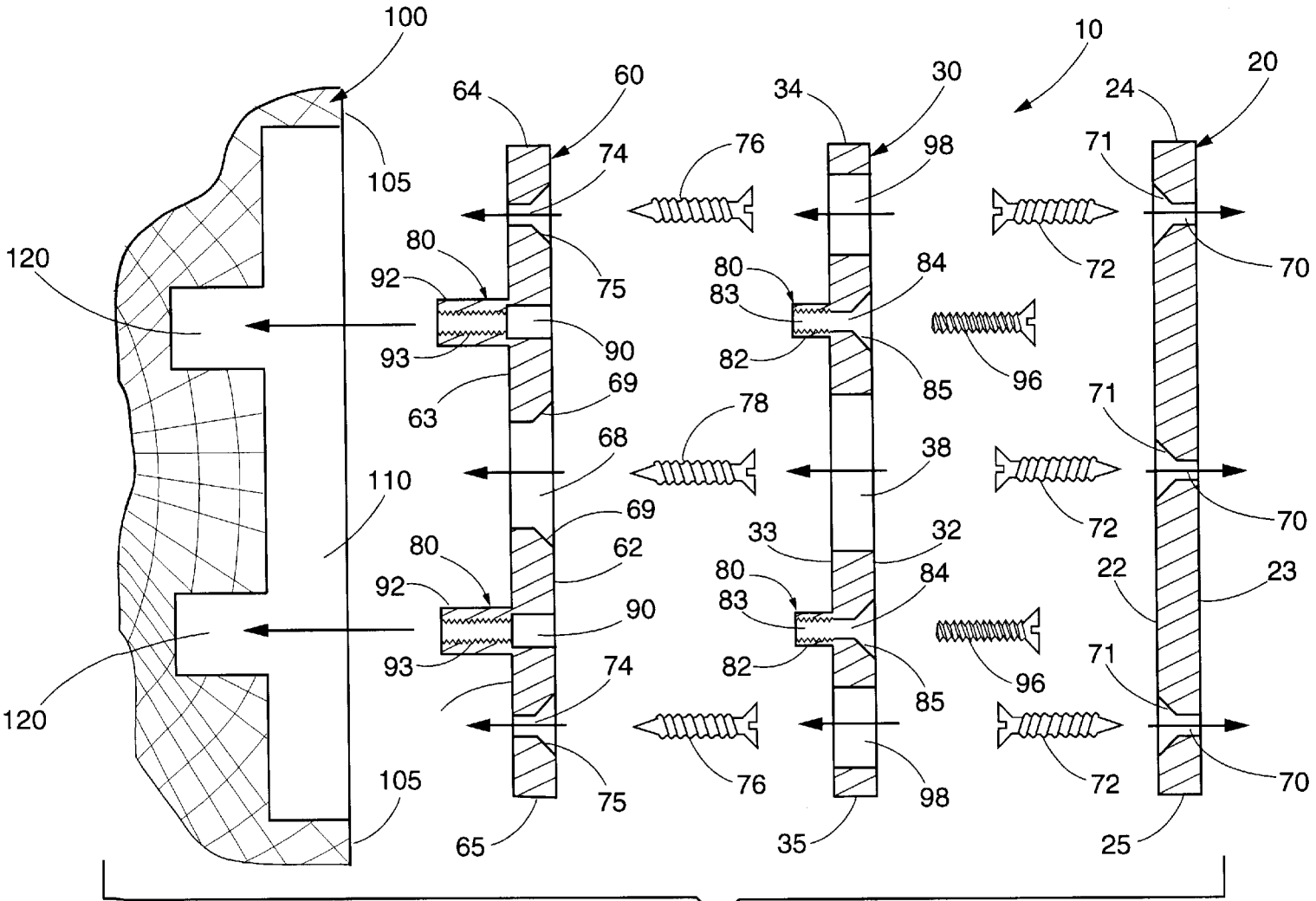
FIG. 4 is an exploded elevational view, shown in cross-section, illustrating attachment of the hinge assembly to a mounting structure.
Figure 5:
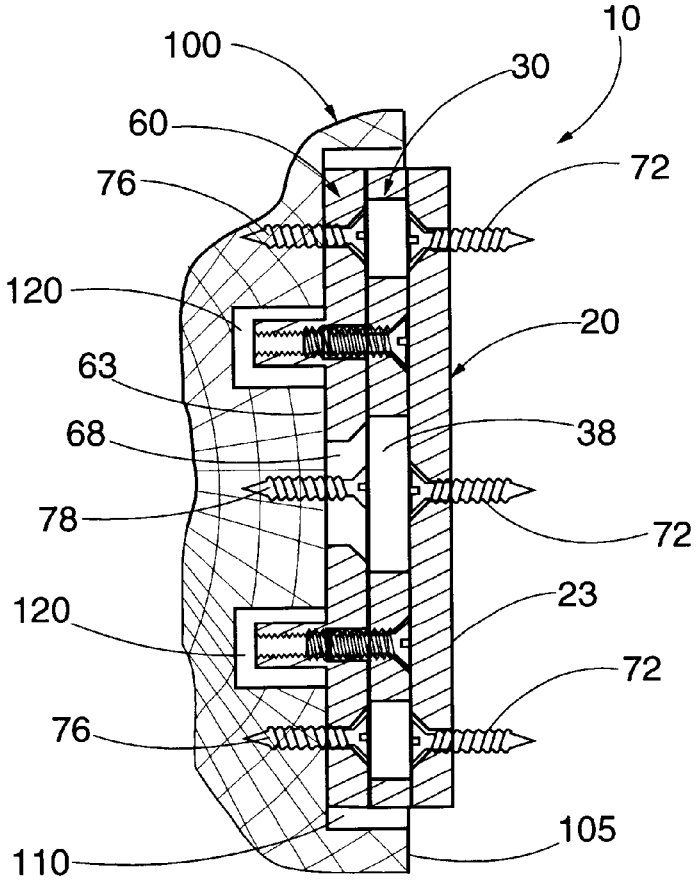
FIG. 5 is a side elevational view, shown in cross-section, showing the hinge assembly attached to a mounting structure.

Referring to the several views of the drawings, the hinge assembly is generally indicated as 10 and includes a first hinge leaf 20, a second hinge leaf 30, and an adjustable mounting plate 60. The first and second hinge leaves 20, 30 are hingedly coupled using hinge pin 50.

The first hinge leaf 20 includes a front face 22, a rear face 23, a top edge 24, a bottom edge 25, and opposite side edges 26, 27.

The second hinge leaf 30 includes a front face 32, a rear face 33, a top edge 34, a bottom edge 35, and opposite side edges 36, 37. A window opening 38 is formed through a central portion of the hinge leaf 30.

The first and second hinge leaves 20, 30 include a plurality of knuckles formed along a side edge thereof. Specifically, the first hinge leaf 20 includes knuckles 40 protruding from the side edge 27. Likewise, second hinge leaf 30 includes knuckles 40' protruding from the side edge 37. The knuckles 40, 40' are formed in a generally cylindrical configuration to include an axial bore extending therethrough. The knuckles 40, 40' are generally identical to those found on conventional hinge leaves of a butt hinge. To hingedly attach the hinge leaves 20, 30, the knuckles 40 are received between the knuckles 40' so that the axial bores 41, 41' of each of the knuckles are disposed in longitudinal, axial alignment for receipt of the hinge pin 50 therethrough. The hinge pin 50 includes an enlarged head 52 to stop the pin 50 once fully inserted, to thereby prevent the hinge pin 50 from passing through and falling from the knuckles. To prevent rising of the hinge pin 50, once inserted, a removable cap 54 is provided. Specifically, the removable cap 54 resembles a screw having threads for threaded engagement with a bore 56 formed in the lower end of the hinge pin 50. The screw 54 includes an enlarged head portion which abuts the bottom end of the lowermost knuckle 40' on the second hinge leaf 30 when the pin is fully inserted, thereby preventing rising of the hinge pin 50 as the hinge leaves 20, 30 move relative to one another.

The adjustable mounting plate 60 includes a front face 62, a rear face 63, a top edge 64, a bottom edge 65, and opposite side edges 66, 67. The adjustable mounting plate 60 is further provided with an elongate slot 68 formed in a central zone thereof. The elongate slot is surrounded by a beveled edge 69 on the front face 62.

It is generally intended that the hinge assembly 10 be used for hingedly mounting a door 130 to a structure 100 such as a cabinet frame, casing, door jamb, or the like. In the preferred embodiment, the adjustable mounting plate 60 is mounted to the structure 100 within a mortised area 110 formed in the front face 105 of the structure 100. The mounting plate 60 is initially mounted with mounting screw 78 received through the elongate slot 68, holding the mounting plate 60 within the mortised area 110, and allowing adjustable positioning of the mounting plate 60 relative to the structure 100.

Figure 6:
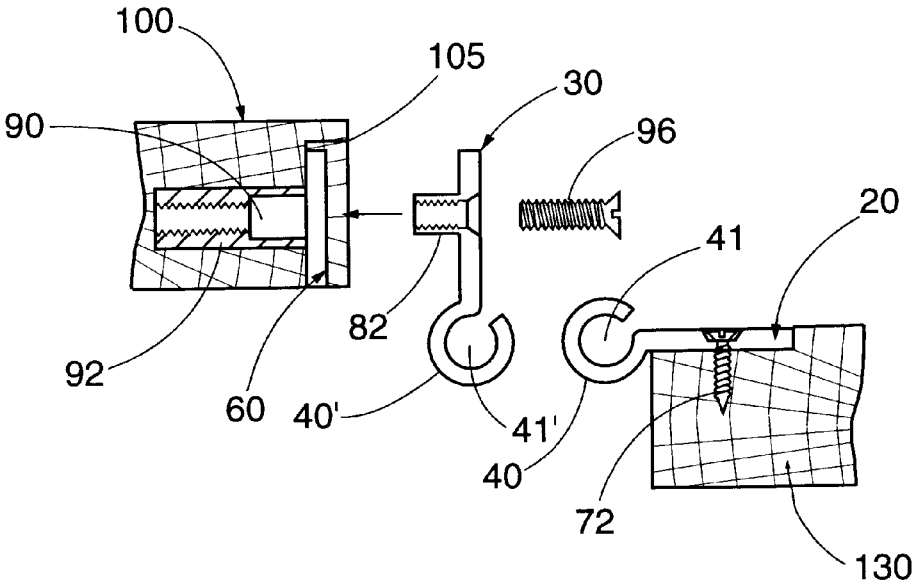
FIG. 6 is a top plan view, in partial section, showing the hinge assembly being attached to a door in the face of a cabinet frame.

The first hinge leaf 20 is attached to the door 130, as best seen in FIG. 6. To accomplish this, a mounting area on the rear face of the door 130 may be mortised to receive the hinge leaf 20 in flush fit engagement therewith. A plurality of through holes 70 are formed in the first hinge leaf 20 for receipt of screws 72 in order to effectively attach the first hinge leaf 20 to the door 130. In a preferred embodiment, the through holes 70 are provided with countersunk surfaces 71 on the front face 22 for flush receipt of the screws 72 therein.

The second hinge leaf 30 is attached to the adjustable mounting plate 60 so that the rear face 33 of the second hinge leaf 30 mates against the front face 62 of the mounting plate 60. Attachment means 80 are provided for attaching the second hinge leaf 30 to the mounting plate 60. Specifically, the attaching means 80 includes a pair of cylinders 82 extending from the rear face 33 of the hinge leaf 30 for fitted, congruent receipt within cylindrical cavities 90 formed through the front face 62 of the mounting plate 60. The second hinge leaf 30 further includes through holes 80 in axial alignment with a threaded bore extending through the protruding cylindrical portions 82. The openings 84 are surrounded by beveled surfaces 85. The mounting plate 60 further includes cylindrical protrusions 92 extending from the rear face 63 thereof, each of the cylindrical protrusions 92 including a threaded interior bore 93 in axial alignment with the cavities 90. To attach the second hinge leaf 30 to the mounting plate 60, the cylindrical portions 82 are fitted within the cavities 90 so that the axial threaded bores 83, 93 align. A machine screw 96 is threadably advanced through the aligned axial bores 83, 93 until the machine screws 96 are flush with the countersunk surfaces 85, with the threaded shaft of the machine screws 96 disposed in threaded engagement with the threaded bores 83, 93. To accommodate the cylindrical protrusions 92 on the mounting plate, cavities 120 are drilled into the mounting structure 100, within the mortised area 110. It is important that the cavities 120 be larger than the cylindrical protrusions 92 of the mounting plate 60, to permit movement of the mounting plate 60 and cylindrical protrusions 92 within the mortised area and cavities of the mounting structure 100.

Once the first hinge leaf 20 is properly attached to the door 130 and the second hinge leaf 30 is attached to mounting plate 60, the mounting plate and second hinge leaf 30 are temporarily positioned and attached to the structure 100 with mounting screw 78 received through the elongate slot 68 and into the structure 100. At this point, the mounting plate 60 and second hinge leaf 30, coupled thereto, are movable vertically and rotatably about the mounting screw 78 within the mortised area 110 and relative to the face 105 of the structure 100.

It is recognized that in mounting a door to the structure 100, several of the hinge assemblies 10 will be used, and typically two to three hinge assemblies. Thus, at least two of the first hinge leaves 20 will be attached to the door 100 in spaced relation to one another, in the same general manner as with any conventional hinge assembly. Likewise, at least two corresponding second hinge leaves and mounting plates are secured to the structure 100 for hinged coupling to the corresponding first hinge leaves 20.

Once the hinge leaf 20 is attached to the door, and the second hinge leaves and mounting plates are attached to the structure 100, the first and second hinge leaves are hingedly coupled together with the hinge pin 50, thereby effectively hanging the door 130 on the structure 100. The door 130 is then adjustably positioned so that it is properly aligned relative to the structure 100. This is achieved by moving the door and the entire hinge assembly 10 relative to the structure 100. Specifically, the first and second hinge leaves 20, 30 are coupled together and hinge leaf 30 is further fixedly attached to mounting plate 60. Therefore, movement of the door results in movement of the entire hinge assembly 10, in unison, relative to the mounting screw 70 and structure 100. The hinge assembly is thus able to move vertically, as the mounting screw 78 has not yet been tightened against the beveled surface 69 of the elongate slot 68 of the mounting plate 60. Furthermore, the door and hinge assembly are able to be partially rotated, tilting the door to the left or to the right, as the mounting plate 60 turns clockwise or counterclockwise relative to the mounting screw 78. Once the door has been properly aligned relative to the mounting structure 100, the mounting screw 78 is tightened within the slot 78 so that the head of the mounting screw 78 is pressed tight against the beveled surface 69 of the slot 68. Access to the mounting screw 78 is enabled by window 38 formed through the second hinge leaf 30. Finally, the mounting plate 60 is firmly set and mounted in position with screws 76 which are received through holes 74 in the mounting plate and into the mounting structure. Again, the holes 74 may be provided with a countersunk surface 75 for flush fit engagement of the head of the screws 76. Enlarged holes 98 formed through the second hinge leaf 30 facilitate access to the screws 76 when the hinge leaf 30 is attached to the mounting plate 60.

While the instant invention has been shown and described in accordance with a preferred and practical embodiment thereof, it is recognized that departures may be made from the instant disclosure which, therefore, should not be limited except as set forth in the following claims as interpreted under the doctrine of equivalents.

What is claimed is:

1. A hinge assembly comprising:

a first hinge leaf including a front face, a rear face, a top edge, a bottom edge, and opposite side edges;

a second hinge leaf including a front face, a rear face, a top edge, a bottom edge, and opposite side edges, and a window opening formed through a central zone;

said first and second hinge leaves each including a plurality of knuckles formed along and protruding from one of said opposite side edges, said knuckles each including a bore extending therethrough, and said knuckles being structured and disposed to mesh together so that said bores are positioned in longitudinal axial alignment;

a hinge pin sized for sliding receipt through said axially aligned bores of said knuckles to hingedly couple said first and second hinge leaves together, and said hinge pin defining a hinge axis about which said first and second hinge leaves are movable relative to one another and said hinge pin;

an adjustable mounting plate including a front face, a rear face, a top edge, a bottom edge, opposite sides edges, and an elongate slot for receipt of a mounting screw therethrough; and means for attaching said second hinge leaf to said adjustable mounting plate so that said rear face of said second hinge leaf is disposed in overlying mating engagement with said front face of said adjustable mounting plate with said window of said second hinge leaf positioned to expose said elongate slot, thereby providing access to the mounting screw.

2. The hinge assembly as recited in claim 1 further comprising:

a plurality of apertures formed through said first hinge leaf for receipt of mounting screws therethrough to mount said first hinge leaf to a door;

a plurality of apertures formed through said adjustable mounting plate for receipt of mounting screws to mount said adjustable mounting plate to a structure adjacent the door; and means formed through said second hinge leaf to facilitate access to the mounting screws received through said mounting plate.

3. The hinge assembly as recited in claim 1 wherein said means for attaching said second hinge leaf to said adjustable mounting plate comprises:

a first pair of cylindrical members protruding from said rear face of said second hinge leaf and each including an axial threaded bore extending therethrough;

a second pair of cylindrical members protruding from said rear face of said adjustable mounting plate and each including an anterior cavity and an axial threaded bore;

said anterior cavity of each of said second cylindrical portions being sized and configured for receipt of a respective one of said first pair of cylindrical portions on said second hinge leaf so that said axial threaded bores through said first cylindrical portions are disposed in axial alignment with said axial threaded bores of said correspondingly positioned second cylindrical portions, said aligned axial threaded bores being structured and disposed for receipt of a threaded screw therethrough to couple and interconnect each of said respective pair of said first cylindrical portions to said correspondingly positioned second cylindrical portions so that said rear face of said second hinge leaf is disposed in mating, overlying engagement with said front face of said adjustable mounting plate.

4. A hinge assembly comprising:

a first hinge leaf including a front face and a rear face;

a second hinge leaf including a front face, a rear face, and a window opening formed through a central zone;

means for hingedly coupling said first and second hinge leaves so that said first and second hinge leaves are movable relative to one another about a common hinge axis;

an adjustable mounting plate including a front face, a rear face, and an elongate slot for receipt of a mounting screw therethrough; and means for attaching said second hinge leaf to said adjustable mounting plate so that said rear face of said second hinge leaf is disposed in overlying mating engagement with said front face of said adjustable mounting plate with said window of said second hinge leaf positioned to expose said elongate slot, thereby providing access to the mounting screw.

5. The hinge assembly as recited in claim 4 further comprising:

a plurality of apertures formed through said first hinge leaf for receipt of mounting screws therethrough to mount said first hinge leaf to a door;

a plurality of apertures formed through said adjustable mounting plate for receipt of mounting screws to mount said adjustable mounting plate to a structure adjacent the door; and means formed through said second hinge leaf to facilitate access to the mounting screws received through said mounting plate.

6. The hinge assembly as recited in claim 4 wherein said means for attaching said second hinge leaf to said adjustable mounting plate comprises:

a first pair of cylindrical members protruding from said rear face of said second hinge leaf and each including an axial threaded bore extending therethrough;

a second pair of cylindrical members protruding from said rear face of said adjustable mounting plate and each including an anterior cavity and an axial threaded bore;

said anterior cavity of each of said second cylindrical portions being sized and configured for receipt of a respective one of said first pair of cylindrical portions on said second hinge leaf so that said axial threaded bores through said first cylindrical portions are disposed in axial alignment with said axial threaded bores of said correspondingly positioned second cylindrical portions, said aligned axial threaded bores being structured and disposed for receipt of a threaded screw therethrough to couple and interconnect each of said respective pair of said first cylindrical portions to said correspondingly positioned second cylindrical portions so that said rear face of said second hinge leaf is disposed in mating, overlying engagement with said front face of said adjustable mounting plate.

* * * * *